US006565386B1

(12) United States Patent
Yoneyama et al.

(10) Patent No.: US 6,565,386 B1
(45) Date of Patent: May 20, 2003

(54) ELECTRICAL CONNECTOR

(75) Inventors: Atsushi Yoneyama, Tu-Chen (TW); Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/104,970

(22) Filed: Mar. 21, 2002

(30) Foreign Application Priority Data

Dec. 26, 2001 (TW) ..... 90222987

(51) Int. Cl.[7] ..... H01R 13/648

(52) U.S. Cl. ..... 439/607

(58) Field of Search ..... 439/358, 357, 439/607–610

(56) References Cited

U.S. PATENT DOCUMENTS 6,171,150 B1 * 1/2001 Saito et al. ..... 439/607
6,179,661 B1 * 1/2001 Chiou ..... 439/607
6,257,929 B1 * 7/2001 Wang ..... 439/607
6,358,089 B1 * 3/2002 Kuroda et al. ..... 439/607

* cited by examiner

*Primary Examiner*—Gary V. Paumen
(74) *Attorney, Agent, or Firm*—Wei Te Chung

(57) ABSTRACT

An electrical connector includes an insulative housing and a shielding plate attached to the housing. The housing includes a pair of locking arms extending from opposite ends thereof substantially along a direction along which the shielding plate is attached to the housing. The shielding plate includes opposite side portions engaging with the locking arms of the housing. Each locking arm of the housing has a protrusion. Each side portion of the shielding plate defines an opening engagingly receiving the protrusion of the locking arm therein.

1 Claim, 5 Drawing Sheets

ELECTRICAL CONNECTOR

BACKGROUND OF THE INVENTION

1. Field of the Invention

The present invention generally relates to electrical connectors, and particular to an electrical connector having a pair of locking arms to fix a shielding plate thereto.

2. Description of the Prior Art

Referring to FIGS. 4 and 5, a conventional electrical connector 2 comprises an insulating housing 40 and a shielding plate 50 attached to the housing 40. A pair of locking arms 60 for engaging with the shielding plate 50 thereby fixing the shielding plate to the housing 40 extends from opposite ends of the insulating housing 40.

However, while the connector 2 is at the position as shown in FIG. 4, the shielding plate 50 is supported in part by the free ends of the locking arms 60 which are apt to vibrate. In addition, while the connector 2 is at the position as shown in FIG. 5, a withdrawal force acting upon the shielding plate 50 causes a force from the side portion of the shielding plate 50 to the latch 61 which causes a moment of force which trends to disengage the locking arms 60 from the shielding plate 50.

SUMMARY OF THE INVENTION

Accordingly an object of the present invention is to provide an electrical connector having a pair of locking arms to securely attach a shielding plate to a housing thereof.

To achieve the object mentioned above, an electrical connector of the present invention includes an insulative housing and a shielding plate attached to the housing. The housing includes a pair of locking arms extending from opposite ends thereof substantially along a direction along which the shielding plate is attached to the housing. The shielding plate includes opposite side portions engaging with the locking arms of the housing. Each locking arm of the housing has a protrusion. Each side portion of the shielding plate defines an opening engagingly receiving the protrusion of the locking arm therein.

Other objects, advantages and novel features of the invention will become more apparent from the following detailed description when taken in conjunction with the accompanying drawings.

DETAILED DESCRIPTION OF THE INVENTION

Figure 1:
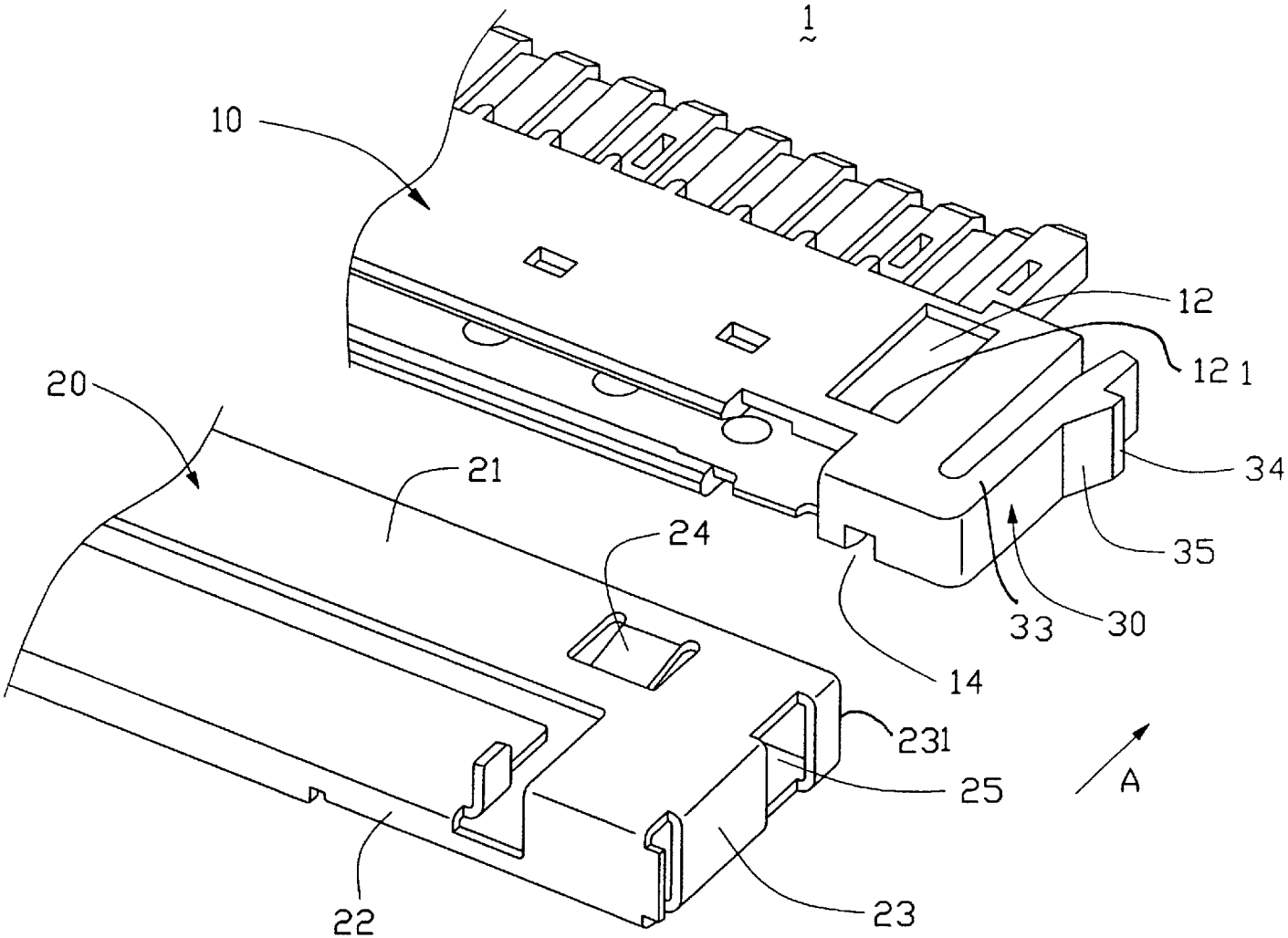
FIG. 1 is an exploded perspective view of an electrical connector in accordance with the present invention.

Referring to FIG. 1, an electrical connector 1 in accordance with the present invention includes an insulative housing 10 receiving a plurality of terminals (not shown) therein and a shielding plate 20 attached to the housing 10.

A pair of locking arms 30 (only one shown)extends from opposite ends of the insulative housing 10 generally along direction A. Each locking arm 30 has a protrusion 34 at outer side surface. A guiding face 35 is formed at each protrusion 34. A rectangular recess 12 is defined in the insulative housing 10 from a top surface of the housing 10. A guiding groove 14 is defined in the housing 10 from a bottom surface of the housing 10.

The shielding plate 20 includes an upper portion 21, a lower portion 22 and opposite side portions 23 connected between the upper and lower portions 21, 22. A pair of openings 25 (only one shown)is defined in the side portions 23, respectively for receiving the protrusions 34 of the housing 10. A spring finger 24 extends from the upper portion 21 and toward the lower portion 22 for engaging with the recess 12 in the housing 10. A guiding tab 211 (see FIG. 2) extends from the lower portion 22 and toward the upper portion 21 for being received in the guiding groove 14 in the housing 10 thereby guiding the shielding plate 20 to attach to the housing 10.

Figure 2:
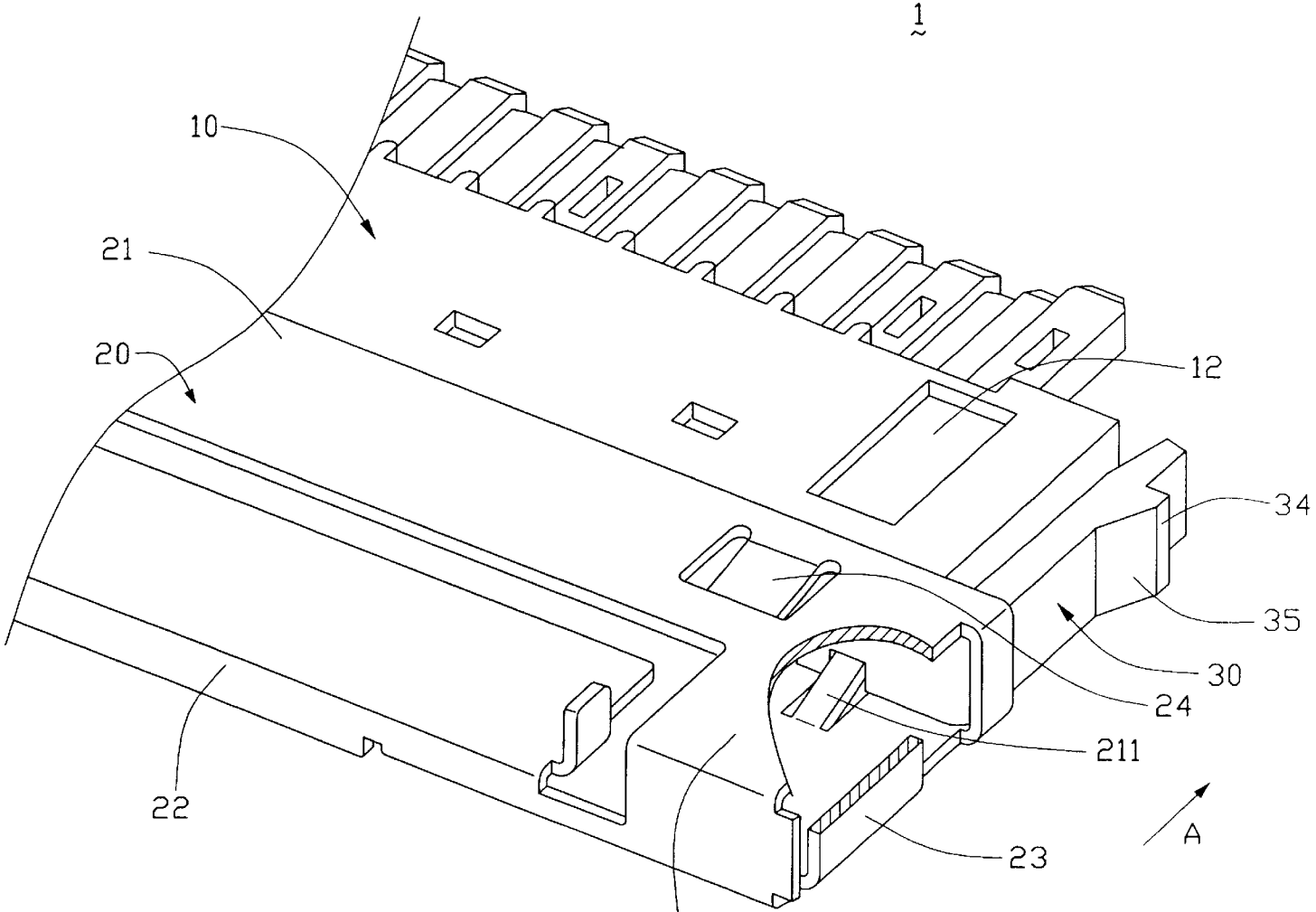
FIG. 2 is a partially assembled view of FIG. 1 with a section of a shielding plate of FIG. 1 cut away.
Figure 3:
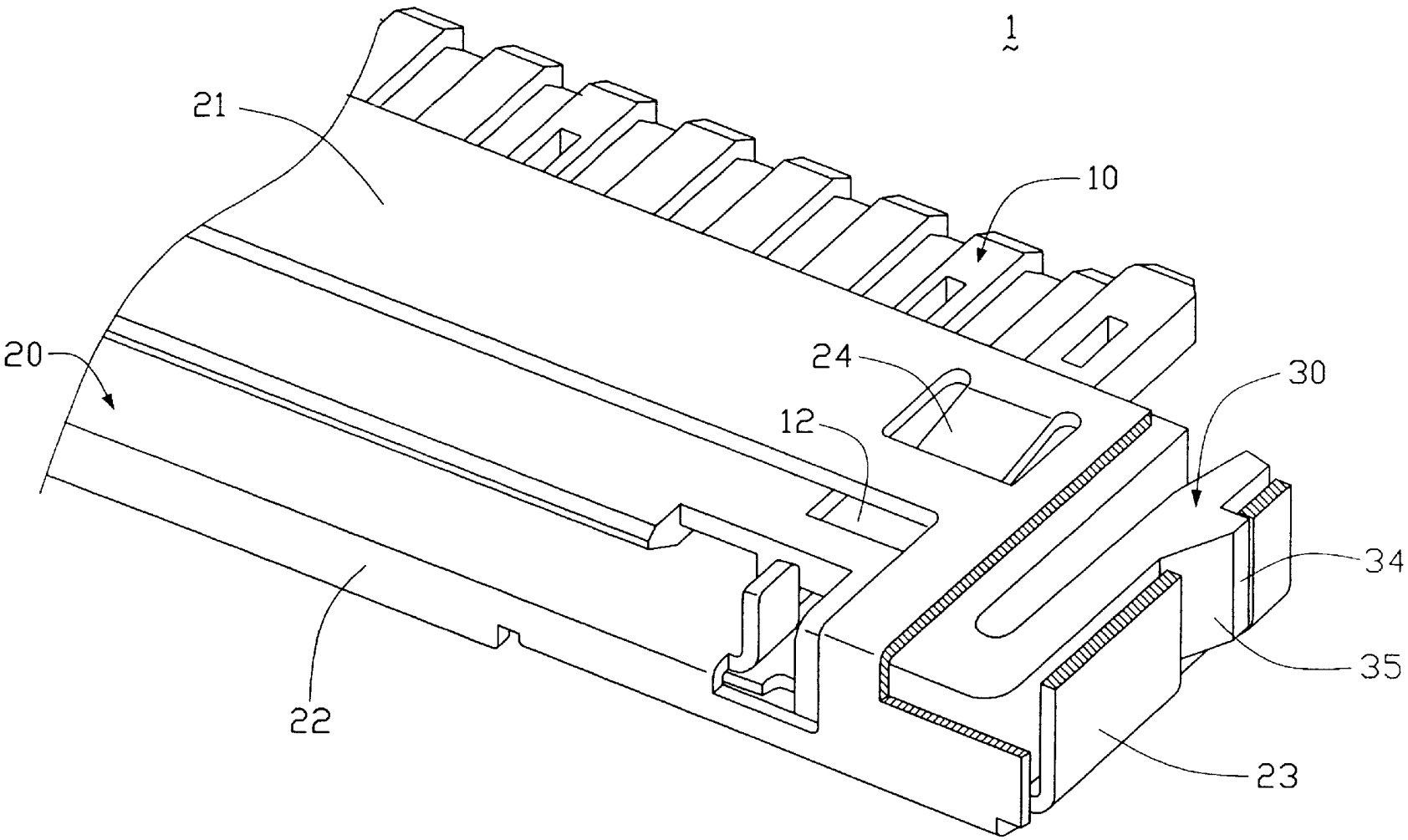
FIG. 3 is an assembled view of FIG. 1 with a section of the shielding plate cut away.
Figure 4:
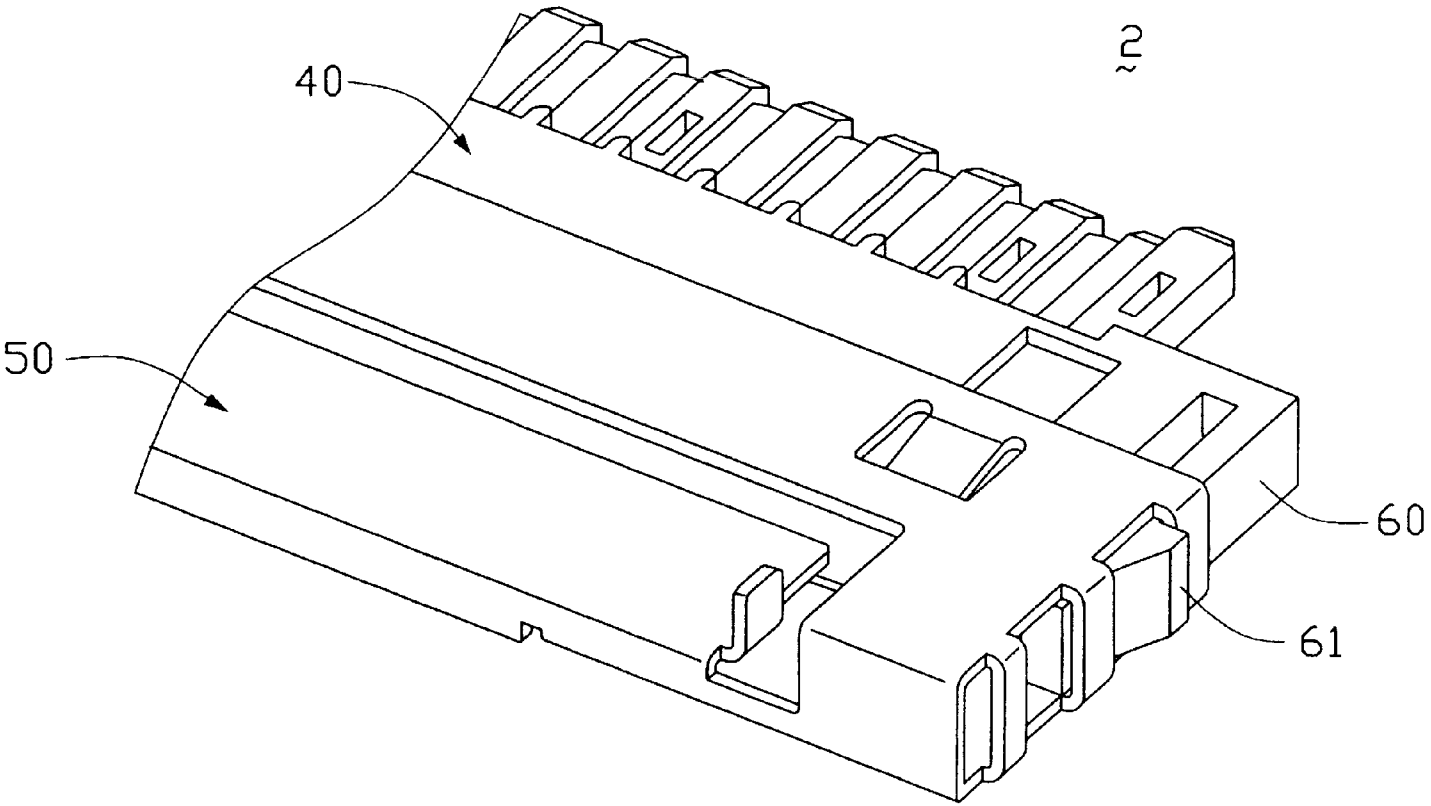
FIG. 4 (PRIOR ART)
FIG. 4 is a partially assembled view of a conventional electrical connector.
Figure 5:
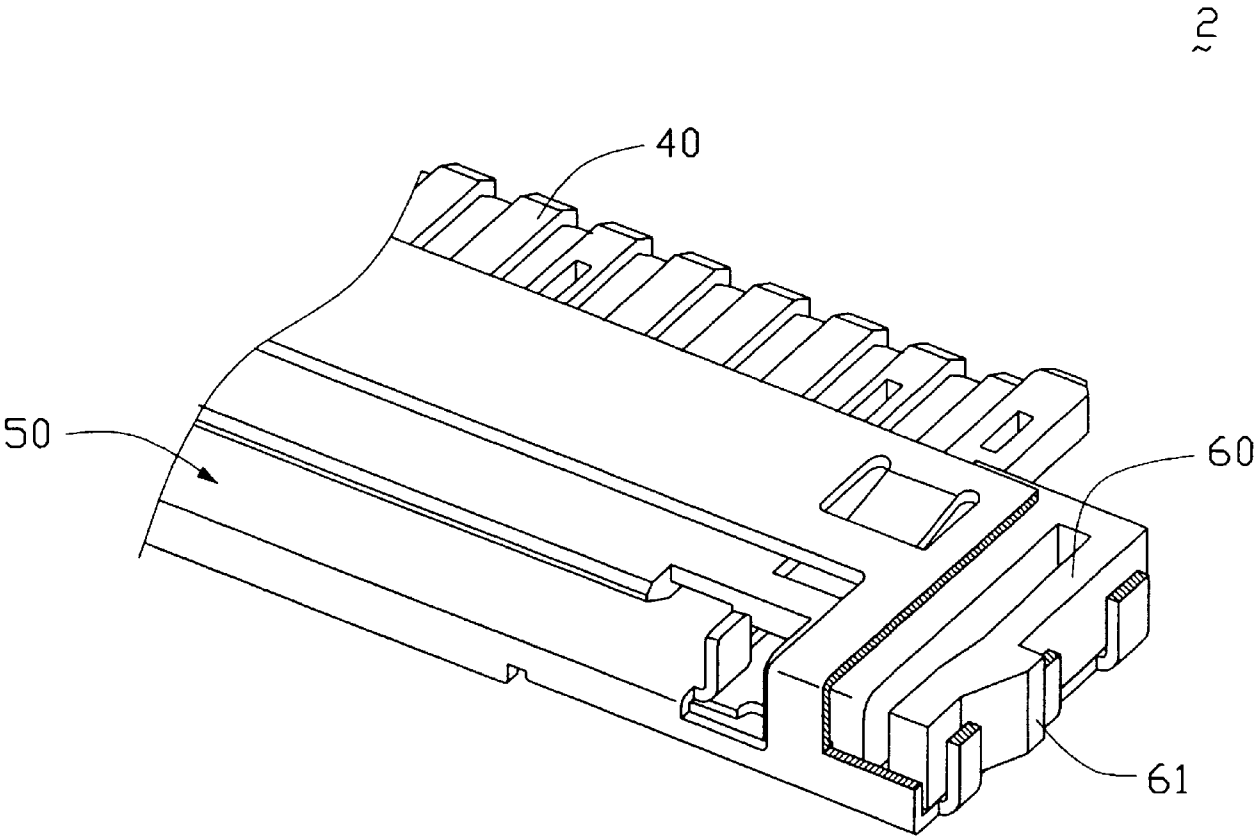
FIG. 5 (PRIOR ART)
FIG. 5 is an assembled view of FIG. 4.

Referring to FIGS. 1–3, in assembly, the shielding plate 20 is attached to the insulative housing 10 along direction A. The guiding groove 14 of the housing 10 receives the tab 211 of the shielding plate 20 therein. The rectangular recess 12 of the housing 10 engagingly receives the spring finger 24 of the shielding plate 20 therein. The locking arms 30 of the housing 10 abut against the side portions 23 of the shielding plate 20. The protrusions 34 of the locking arms 30 are engagingly received in the openings 25 of the side portions 23 and therefore exert a force to the protrusions respectively. The force causes a moment outwardly acting on the locking arm 30 from the junction of each locking arm 30 and the housing 10. Since the side portions 23 of the shielding plate 20 abut against the locking arm 30 and bear the moment, the shielding plate 20 is securely attached to the housing 10. FIG. 3 shows the shielding plate 20 is retained in a closed position with regard to the housing 10. Oppositely, when the shielding plate 20 is in an open position relative to the housing 10 (not shown in the figures), the protrusion 34 is seated upon the edge 231 of the side portion 23 and the distal end (not shown and not labeled) abuts against the edge 121 of the recess 12 so as to retain the shielding plate 20 relative to the housing 10 in position. Under this situation, the junction between the locking arm 30 and the housing 10 are engageably embedded within the shielding plate 20, and the root portion 33 of the locking arm 30 is protectively engaged with the corresponding side portion 23.

It is to be understood, however, that even though numerous, characteristics and advantages of the present invention have been set forth in the forgoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing comprising a pair of locking arms extending from opposite ends thereof substantially along a first direction;

a shielding plate attached to the housing along the first direction, the shielding plate comprising opposite side portions engaging with the locking arms of the housing;

wherein each locking arm of the housing has a protrusion, and wherein each side portion of the shielding plate defines an opening engagingly receiving the protrusion of the locking arm therein;

wherein the shielding plate comprises an upper portion and a lower portion, and wherein the opposite side portions connect between the upper and lower portions;

wherein a spring finger extends from the upper portion of the shielding plate, and wherein a recess is defined in the housing and receives the spring finger therein;

wherein a guiding tab extends from the lower portion of the shielding plate, and wherein a guiding groove is defined in the housing and receives the guiding tab therein.

* * * * *